US011463818B2

(12) United States Patent
Rosenkranz et al.

(10) Patent No.: US 11,463,818 B2
(45) Date of Patent: Oct. 4, 2022

(54) HEARING SYSTEM HAVING AT LEAST ONE HEARING INSTRUMENT WORN IN OR ON THE EAR OF THE USER AND METHOD FOR OPERATING SUCH A HEARING SYSTEM

(71) Applicant: SIVANTOS PTE. LTD., Singapore (SG)

(72) Inventors: Tobias Daniel Rosenkranz, Bubenreuth (DE); Sebastian Best, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 17/172,289

(22) Filed: Feb. 10, 2021

(65) Prior Publication Data

US 2021/0250705 A1 Aug. 12, 2021

(30) Foreign Application Priority Data

Feb. 10, 2020 (DE) ..... 10 2020 201 615.1

(51) Int. Cl.
*H04R 25/00* (2006.01)

(52) U.S. Cl.
CPC ..... *H04R 25/356* (2013.01); *H04R 25/30* (2013.01); *H04R 25/43* (2013.01); *H04R 25/606* (2013.01)

(58) Field of Classification Search
CPC ..... H04R 25/00
USPC ..... 381/312
See application file for complete search history.

(56) References Cited

U.S. PATENT DOCUMENTS

| | | | | |
|---|---|---|---|---|
| 6,240,192 | B1 * | 5/2001 | Brennan | H04R 25/505 381/314 |
| 6,661,901 | B1 | 12/2003 | Svean et al. | |
| 8,325,956 | B2 * | 12/2012 | Neher | H04R 25/353 381/23.1 |
| 9,307,332 | B2 | 4/2016 | Rasmussen et al. | |
| 9,788,127 | B2 | 10/2017 | Giese et al. | |
| 9,949,040 | B2 | 4/2018 | Bergmann et al. | |
| 9,973,861 | B2 | 5/2018 | Rosenkranz et al. | |
| 10,327,071 | B2 | 6/2019 | Pedersen | |

(Continued)

FOREIGN PATENT DOCUMENTS

| | | | |
|---|---|---|---|
| DE | 102015204639 | B3 | 7/2016 |
| DE | 102018216667 | B3 | 1/2020 |

(Continued)

*Primary Examiner* — Suhan Ni
(74) *Attorney, Agent, or Firm* — Laurence A. Greenberg; Werner H. Stemer; Ralph E. Locher

(57) ABSTRACT

A hearing system assists the hearing of a user and has a hearing instrument worn in or on the ear of the user. In operation, a sound signal from surroundings of the hearing instrument is received by an input transducer and modified in a signal processing step. The modified sound signal is output by an output transducer. A first signal component and a second signal component are derived from the received sound signal, wherein these signal components chronologically overlap. In the first signal component, the ego voice of the user is emphasized over the ambient noise, while in the second signal component, the ambient noise is emphasized over the ego voice of the user. The first signal component and the second signal component are processed in different ways in the signal processing step and combined after this processing to generate the modified sound signal.

8 Claims, 2 Drawing Sheets

(56) References Cited

U.S. PATENT DOCUMENTS

| | | | | |
|---|---|---|---|---|
| 10,403,306 | B2 | 9/2019 | Kamkar Parsi et al. | |
| 2013/0148829 | A1 | 6/2013 | Lugger | |
| 2016/0360326 | A1* | 12/2016 | Bergmann | H04R 25/43 |
| 2019/0019526 | A1* | 1/2019 | Sørensen | H04R 25/00 |
| 2020/0107139 | A1 | 4/2020 | Lugger et al. | |

FOREIGN PATENT DOCUMENTS

| | | | |
|---|---|---|---|
| EP | 2352312 | A1 | 8/2011 |
| EP | 3101919 | A1 | 12/2016 |
| EP | 2991379 | B1 | 5/2017 |
| EP | 3188507 | A1 | 7/2017 |
| WO | 2016078786 | A1 | 5/2016 |

* cited by examiner

HEARING SYSTEM HAVING AT LEAST ONE HEARING INSTRUMENT WORN IN OR ON THE EAR OF THE USER AND METHOD FOR OPERATING SUCH A HEARING SYSTEM

CROSS-REFERENCE TO RELATED APPLICATION

This application claims the priority, under 35 U.S.C. § 119, of German patent application DE 10 2020 201 615.1, filed Feb. 10, 2020; the prior application is herewith incorporated by reference in its entirety.

BACKGROUND OF THE INVENTION

Field of the Invention

The invention relates to a method for operating a hearing system for assisting the sense of hearing of a user, having at least one hearing instrument worn in or on the ear of the user. The invention furthermore relates to such a hearing system.

A hearing instrument generally refers to an electronic device which assists the sense of hearing of a person (who is referred to hereinafter as the "wearer" or "user") wearing the hearing instrument. In particular, the invention relates to hearing instruments which are configured for the purpose of entirely or partially compensating for a hearing loss of a hearing-impaired user. Such a hearing instrument is also referred to as a "hearing aid". In addition, there are hearing instruments which protect or improve the sense of hearing of users having normal hearing, for example are to enable improved speech comprehension in complex hearing situations.

Hearing instruments in general, and especially hearing aids, are usually designed to be worn in or on the ear of the user, in particular as behind-the-ear devices (also referred to as BTE devices) or in-the-ear devices (also referred to as ITE devices). With respect to their internal structure, hearing instruments generally include at least one (acousto-electrical) input transducer, a signal processing unit (signal processor), and an output transducer. In operation of the hearing instrument, the input transducer receives airborne sound from the surroundings of the hearing instrument and converts this airborne sound into an input audio signal (i.e., an electrical signal which transports information about the ambient sound). This input audio signal is also referred to hereinafter as the "received sound signal". The input audio signal is processed (i.e., modified with respect to its sound information) in the signal processing unit in order to assist the sense of hearing of the user, in particular to compensate for a hearing loss of the user. The signal processing unit outputs a correspondingly processed audio signal (also referred to as the "output audio signal" or "modified sound signal") to the output transducer. In most cases, the output transducer is designed as an electro-acoustic transducer, which converts the (electrical) output audio signal back into airborne sound, wherein this airborne sound—modified in relation to the ambient sound—is emitted into the auditory canal of the user. In the case of a hearing instrument worn behind the ear, the output transducer, which is also referred to as a "receiver", is usually integrated outside the ear into a housing of the hearing instrument. The sound output by the output transducer is conducted in this case by means of a sound tube into the auditory canal of the user. Alternatively thereto, the output transducer can also be arranged in the auditory canal, and thus outside the housing worn behind the ear. Such hearing instruments are also referred to as RIC ("receiver in canal") devices. Hearing instruments worn in the ear, which are dimensioned sufficiently small that they do not protrude to the outside beyond the auditory canal, are also referred to as CIC ("completely in canal") devices.

In further constructions, the output transducer can also be configured as an electromechanical transducer which converts the output audio signal into structure-borne sound (vibrations), wherein this structure-borne sound is emitted, for example into the skull bone of the user. Furthermore, there are implantable hearing instruments, in particular cochlear implants, and hearing instruments, the output transducers of which directly stimulate the auditory nerve of the user.

The term "hearing system" refers to a single device or a group of devices and possibly nonphysical functional units, which together provide the functions required in operation of a hearing instrument. The hearing system can consist of a single hearing instrument in the simplest case. Alternatively thereto, the hearing system can comprise two interacting hearing instruments for supplying both ears of the user. In this case, this is referred to as a "binaural hearing system". Additionally or alternatively, the hearing system can comprise at least one further electronic device, for example a remote control, a charging device, or a programming device for the or each hearing aid. In modern hearing systems, a control program, in particular in the form of a so-called app, is often provided instead of a remote control or a dedicated programming device, wherein this control program is designed for implementation on an external computer, in particular a smart phone or tablet. The external computer itself is regularly not part of the hearing system and in particular is generally also not provided by the producer of the hearing system.

A common problem in operation of a hearing system is that the ego voice of the user is reproduced in a distorted manner, in particular too loud and having a tone perceived as unnatural, by the hearing instrument or the hearing instruments of the hearing system. This problem is at least partially solved in modern hearing systems in that time windows (ego voice intervals) of the recorded sound signal, in which this sound signal contains the ego voice of the user, are recognized therein. These ego voice intervals are processed differently in the hearing instrument, in particular amplified less, than other intervals of the recorded sound signal, which do not contain the voice of the user.

However, in addition to the ego voice of the user, other components (ambient noise) of the recorded sound signal are influenced due to the changed signal processing in ego voice intervals by such signal processing methods. If the user speaks intermittently (i.e., in short intervals interrupted by speech pauses) in operation of the hearing system, this regularly results in a modulation of the ambient noise, which is frequently perceived to be annoying.

BRIEF SUMMARY OF THE INVENTION

The invention is based on the object of enabling signal processing improved under this aspect in a hearing system.

With respect to a method, this object is achieved according to the invention by the features of the independent method claim. With respect to a hearing system, the object is achieved according to the invention by the features of the independent hearing system claim. Advantageous embodiments or refinements of the invention, which are partially inventive considered as such, are specified in the dependent claims and the following description.

The invention generally proceeds from a hearing system for assisting the sense of hearing of a user, wherein the hearing system includes at least one hearing instrument worn in or on an ear of the user. As described above, in simple embodiments of the invention, the hearing system can consist exclusively of a single hearing instrument. However, the hearing system preferably contains at least one further component in addition to the hearing instrument, for example a further (in particular equivalent) hearing instrument for supplying the other ear of the user, a control program (in particular in the form of an app) for execution on an external computer (in particular a smart phone) of the user, and/or at least one further electronic device, for example a remote control or a charging device. The hearing instrument and the at least one further component have a data exchange with one another, wherein functions of data storage and/or data processing of the hearing system are divided among the hearing instrument and the at least one further component.

The hearing instrument includes at least one input transducer for receiving a sound signal (in particular in the form of airborne sound) from surroundings of the hearing instrument, a signal processing unit for processing (modifying) the received sound signal to assist the sense of hearing of the user, and an output transducer for outputting the modified sound signal. If the hearing system includes a further hearing instrument for supplying the other ear of the user, this further hearing instrument preferably also includes at least one input transducer, a signal processing unit, and an output transducer.

The or each hearing instrument of the hearing system is provided in particular in one of the constructions described at the outset (BTE device having internal or external output transducer, ITE device, for example CIC device, hearing implant, in particular cochlear implant, etc.). In the case of a binaural hearing system, both hearing instruments are preferably designed equivalently.

The or each input transducer is in particular an acousto-electrical transducer, which converts airborne sound from the surroundings into an electrical input audio signal. To enable direction-dependent analysis and processing of the received sound signal, the hearing system preferably comprises at least two input transducers, which are arranged in the same hearing instrument or—if provided—can be allocated to the two hearing instruments of the hearing system. The output transducer is preferably configured as an electro-acoustic transducer (receiver), which converts the audio signal modified by the signal processing unit back into airborne sound. Alternatively, the output transducer is designed to emit structure-borne sound or to directly stimulate the auditory nerve of the user.

The signal processing unit preferably contains a plurality of signal processing functions, for example an arbitrary selection from the functions frequency-selective amplification, dynamic compression, spectral compression, direction-dependent damping (beamforming), interference noise suppression, in particular active interference noise suppression (active noise cancellation, abbreviated ANC), active feedback suppression (active feedback cancellation, abbreviated AFC), wind noise suppression, which are applied to the received sound signal, i.e., the input audio signal, in order to prepare it to assist the sense of hearing of the user. Each of these functions or at least a majority of these functions is parameterizable here by one or more signal processing parameters. Signal processing parameter refers to a variable which can be assigned different values in order to influence the mode of action of the associated signal processing function. A signal processing parameter in the simplest case can be a binary variable, using which the respective function is switched on and off. In more complex cases, hearing aid parameters are formed by scalar floating point numbers, binary or continuously variable vectors, or multidimensional arrays, etc. One example of such signal processing parameters is a set of amplification factors for a number of frequency bands of the signal processing unit, which define the frequency-dependent amplification of the hearing instrument.

In the course of the method executed by means of the hearing system, a sound signal is received from the surroundings of the hearing instrument by the at least one input transducer of the hearing instrument, wherein this sound signal at least sometimes includes the ego voice of the user and ambient noise. "Ambient noise" refers here and hereinafter to the component of the received sound signal originating from the surroundings (and thus different from the ego voice of the user). The received sound signal (input audio signal) is modified in a signal processing step to assist the sense of hearing of a user. The modified sound signal is output by means of the output transducer of the hearing instrument.

According to the method, a first signal component and a second signal component are derived from the received sound signal (directly or after preprocessing).

The first signal component (also "ego voice component" hereinafter) is derived in such a way that the ego voice of the user is emphasized therein over the ambient noise; the ego voice of the user is either selectively amplified here (i.e., amplified to a greater extent than the ambient noise) or the ambient noise is selectively damped (i.e., damped to a greater extent than the ego voice of the user).

The second signal component (also referred to as "ambient noise component" hereinafter) in contrast is derived in such a way that the ambient noise is emphasized therein over the ego voice of the user; either the ambient noise is thus selectively amplified here (i.e., amplified to a greater extent than the ego voice) or the ego voice is selectively damped (i.e., damped to a greater extent than the ambient noise). The ego voice of the user is preferably removed from the second signal component completely or at least as much as is possible using signal processing technology.

According to the method, the first signal component (ego voice component) and the second signal component (ambient noise component) are processed in different ways in the signal processing step. In particular, the first signal component is amplified to a lesser extent than the second signal component and/or processed using changed dynamic compression (in particular using reduced dynamic compression, i.e., using a linear amplification characteristic curve). The first signal component is preferably processed here in a manner optimized for the processing of the ego voice of the user (in particular individually, i.e., in a user-specific manner). The second signal component, in contrast, is preferably processed in a manner optimized for the processing of the ambient noise. This processing of the second signal component is optionally in turn varied here in dependence on the type—for example ascertained in the scope of a classification of the hearing situation—of the ambient noise (voice noise, music, driving noise, construction noise, etc.).

After this different processing, the first signal component and the second signal component are combined (superimposed) to generate the modified sound signal. The overall signal resulting from combining the two signals can optionally pass through still further processing steps, in particular can be amplified once again, in the scope of the invention before the output by the output transducer, however.

The two signal components, i.e., the ego voice component and the ambient noise component, are derived here according to the method from the first and second sound signal in such a way that they overlap (completely or at least partially) chronologically. The two signal components thus exist chronologically adjacent to one another and are processed in parallel to one another (i.e., on parallel signal processing paths). These signal components are therefore not chronologically successive intervals of the received sound signal.

The first signal component is preferably derived using direction-dependent damping (beamforming), so that a spatial signal component corresponding to the ambient noise is selectively damped (i.e., is damped more strongly than another spatial signal component in which the ambient noise is not present or is only weakly pronounced). For this purpose, in the scope of the invention, a static (chronologically unvarying) damping algorithm (also beamforming algorithm or beamformer in short) can be used. However, an adaptive direction-dependent beamformer is preferably used, the damping characteristic of which has at least one local or global damping maximum, i.e., at least one direction of maximum damping (notch). This notch (or possibly one of multiple notches) is preferably aligned here on a dominant noise source in a spatial volume at the rear with respect to the head of the user.

The second signal component is preferably also derived by means of direction-dependent damping, wherein either a static or adaptive beamformer is also used. The direction-dependent damping is used here in such a way that a spatial signal component corresponding to the ego voice component is selectively damped (i.e., is damped more strongly than a spatial signal component in which the ego voice of the user is not present or is only weakly pronounced). A notch of the corresponding beamformer is expediently exactly or approximately aligned on the front side with respect to the head of the user. In particular, a beamformer having a damping characteristic corresponding to an anti-cardioid is used.

At least the beamformer used for deriving the second signal component preferably has a frequency-dependent varying damping characteristic. This dependence of the damping characteristic is expressed in particular in a notch width or notch depth varying with the frequency and/or in a notch direction varying slightly with the frequency. The dependence of the damping characteristic on the frequency is set here (for example empirically or using a numeric optimization method) in such a way that the damping of the ego voice in the second signal component is optimized (i.e., reaches a local or global maximum), and thus the ego voice is eliminated as well as possible from the second signal component. This optimization is performed, for example—if a static beamformer is used to derive the second signal component—in the individual adaptation of the hearing system to the user (fitting). Alternatively thereto, an adaptive beamformer is used to derive the second signal component, which optimizes the damping characteristic continuously in operation of the hearing system with regard to the best possible damping of the ego voice of the user. This measure is based on the finding that the ego voice of the user is damped differently by a beamformer than the sound of a sound source arranged frontally at a distance to the user. In particular, the ego voice is not always perceived by the user as coming exactly from the front. Rather, an origin direction (sound incidence direction) for the ego voice in many users, which deviates from the plane of symmetry of the head, results for the ego voice due to slight asymmetries in the anatomy of the head, the individual speech habits of the user, and/or the transmission of the ego voice by structure-borne noise.

The damping characteristic of the beamformer used to derive the first signal component optionally also has a dependence on the frequency, wherein this dependency is determined in such a way that the damping of the ambient signal is optimized in the first signal component (i.e., a local or global maximum is reached), and thus the ambient signal is eliminated as well as possible from the first signal component.

Furthermore, in particular additionally to the above-described direction-dependent filtering, spectral filtering of the received sound signal is preferably used to derive the first signal component (ego voice component) and the second signal component (ambient noise component). To derive the first signal component, preferably at least one frequency component of the received sound signal, in which components of the ego voice of the user are not present or are only weakly pronounced, is selectively damped (i.e., damped more strongly than frequency components of the received sound signal in which the ego voice of the user has dominant components). To derive the second signal component, preferably at least one frequency component of the received sound signal, in which components of the ambient noise are not present or are only weakly pronounced, is selectively damped (i.e., damped more strongly than frequency components of the received sound signal in which the ambient noise has dominant components).

The above-described method, namely the separation of the received sound signal into the ego voice component and the ambient noise component and the parallel, different processing of both signal components, can be carried out uninterruptedly (and according to the same unchanged method) in the scope of the invention in operation of the hearing system, independently of when and how frequently the received sound signal contains the ego voice of the user. In intervals of the received sound signal in which the ego voice of the user is not included, the signal processing path containing the ego voice component runs quasi-empty in this case and processes a signal which does not contain the ego voice of the user.

The separation of the received sound signal into the ego voice component and the ambient noise component and the parallel, different processing of both signal components but only in ego voice intervals are preferably performed if the received sound signal also includes the ego voice of the user. For this purpose, in a signal analysis step, ego voice intervals of the received sound signal are recognized, for example using methods as are known per se from U.S. patent publication No. 2013/0148829 A1 or international patent disclosure WO 2016/078786 A1. The separation of the received sound signal into the first signal component and the second signal component only takes place in recognized ego voice intervals (not in intervals which do not contain the ego voice of the user).

Again alternatively, the separation of the received sound signal into the ego voice component and the ambient noise component and the parallel, different processing of the two signal components is fundamentally carried out both in recognized ego voice intervals and also in the absence of the ego voice of the user, wherein in this case, however, the second signal component (i.e., the ambient noise component) is derived differently, depending on the presence or absence of the ego voice of the user. In ego voice intervals, in this embodiment preferably an algorithm optimized for the damping of the ego voice is used for deriving the ambient noise component, in particular—as described above—a static beamformer having an optimized frequency dependence of the damping characteristic or a self-optimizing dynamic beamformer. In contrast, preferably an algorithm different therefrom (in any case differently parameterized) is applied to intervals of the received sound signal which do not contain the ego voice of the user to derive the ambient noise component, which is oriented to the damping of a sound source arranged frontally with respect to the user but remote from the user (for example a speaker who faces toward the user). This different algorithm is designed, for example, as a static beamformer having a direction-dependent damping characteristic corresponding to an anti-cardioid, wherein this beamformer differs with respect to the shape and/or frequency dependence of the anti-cardioid from the beamformer applied to ego voice intervals to derive the ambient noise component. For example, in the absence of the ego voice of the user, an anti-cardioid without frequency dependence (i.e., an anti-cardioid constant over the frequency) is used to derive the ambient noise component. Preferably, the first signal component (which transports the ego voice of the user in ego voice intervals) is preferably also processed differently here in dependence on the presence or absence of the ego voice of the user. In ego voice intervals, the first signal component is preferably—as described above—processed in a manner optimized for the processing of the ego voice of the user, in contrast, in the absence of the ego voice it is processed in a manner different therefrom.

The hearing system according to the invention is generally configured for automatically carrying out the above-described method according to the invention. The hearing system is thus configured to receive a sound signal from surroundings of the hearing instrument by means of the at least one input transducer of the at least one hearing instrument, wherein the sound signal at least sometimes includes the ego voice of the user and also ambient noise, to modify the received sound signal in the signal processing step to assist the sense of hearing of a user, and to output the modified sound signal by means of the output transducer of the hearing instrument.

The hearing system is furthermore configured to derive the first signal component (ego voice component) and the second signal component—chronologically overlapping therewith—(ambient noise component) from the received sound signal in the above-described manner, to process these two signal components in different ways in the signal processing step, and to combine them after this processing to generate the modified sound signal.

The configuration of the hearing system for automatically carrying out the method according to the invention is of a programming and/or circuitry nature. The hearing system according to the invention thus contains programming means (software) and/or circuitry means (hardware, for example in the form of an ASIC), which automatically carry out the method according to the invention in operation of the hearing system. The programming or circuitry means for carrying out the method can be arranged exclusively in the hearing instrument (or the hearing instruments) of the hearing system in this case. Alternatively, the programming or circuitry means for carrying out the method are distributed to the hearing instrument or the hearing aids and at least one further device or a software component of the hearing system. For example, programming means for carrying out the method are distributed to the at least one hearing instrument of the hearing system and to a control program installed on an external electronic device (in particular a smart phone).

The above-described embodiments of the method according to the invention correspond to corresponding embodiments of the hearing system according to the invention. The statements above on the method according to the invention are transferable accordingly to the hearing system according to the invention and vice versa.

Other features which are considered as characteristic for the invention are set forth in the appended claims.

Although the invention is illustrated and described herein as embodied in a hearing system having at least one hearing instrument worn in or on the ear of the user and a method for operating such a hearing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Identical parts and variables are always provided with identical reference signs in all figures.

Figure 1:
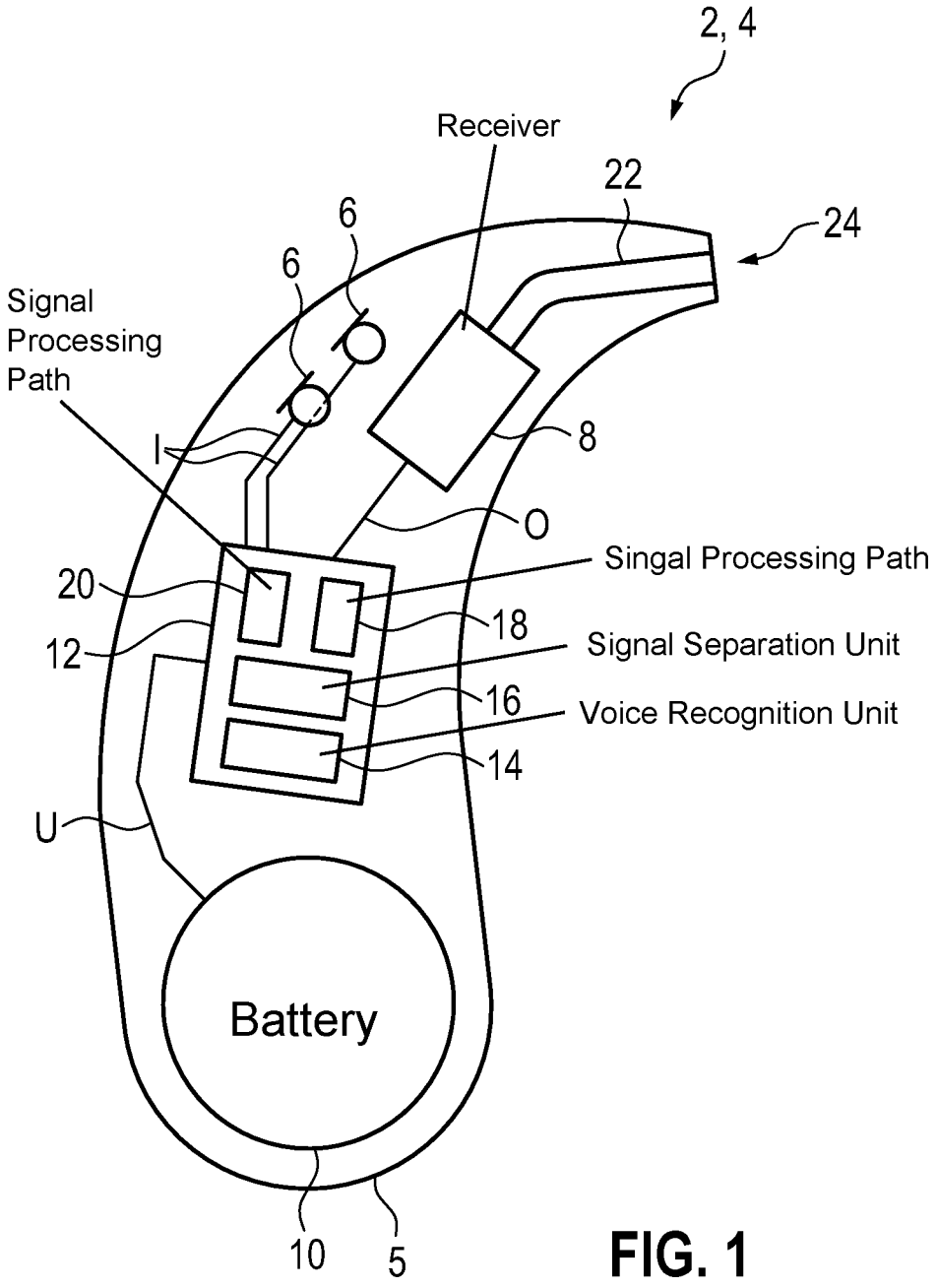
FIG. 1 is a schematic illustration of a hearing system containing a single hearing instrument in a form of a hearing aid wearable behind an ear of a user, in which a sound signal received from the surroundings of the hearing aid is separated into an ego voice component and an ambient noise component chronologically overlapping with it, and in which these two signal components are processed differently and subsequently combined again.

Referring now to the figures of the drawings in detail and first, particularly to FIG. 1 thereof, there is shown a hearing system 2 having a single hearing aid 4, i.e., a hearing instrument configured to assist the sense of hearing of a hearing-impaired user. The hearing aid 4 in the example shown here is a BTE hearing aid wearable behind an ear of a user.

Optionally, in further embodiments of the invention, the hearing system 2 contains a second hearing aid (not expressly shown) for supplying the second ear of the user, and/or a control app that can be installed on a smart phone of the user. The functional components described hereinafter of the hearing system 2 are preferably distributed in these embodiments onto the two hearing aids or onto the at least one hearing aid and the control app.

The hearing aid 4 contains, within a housing 5, at least one microphone 6 (in the illustrated example two microphones 6) as an input transducer and a receiver 8 as an output transducer. In the state worn behind the ear of the user, the two microphones 6 are oriented in such a way that one of the microphones 6 points forward (i.e., in the direction the user is looking), while the other microphone 6 is oriented to the rear (against the direction the user is looking). The hearing aid 4 furthermore has a battery 10 and a signal processing unit in the form of a digital signal processor 12. The signal processor 12 preferably contains both a programmable subunit (for example a microprocessor) and also a nonprogrammable subunit (for example an ASIC). The signal processor 12 contains an (ego voice recognition) unit 14 and a (signal separation) unit 16. In addition, the signal processor 12 includes two parallel signal processing paths 18 and 20.

The units 14 and 16 are preferably configured as software components, which are implemented to be executable in the signal processor 12. The signal processing paths 18 and 20 are preferably formed by electronic hardware circuits (for example on the mentioned ASIC).

The signal processor 12 is supplied with an electrical supply voltage U from the battery 10.

In normal operation of the hearing aid 4, the microphones 6 receive airborne sound from the surroundings of the hearing aid 4. The microphones 6 convert the sound into an (input) audio signal I, which contains information about the received sound. The input audio signal I is supplied to the signal processor 12 within the hearing aid 4.

The signal processor 12 processes the input audio signal I in each of the signal processing paths 18 and 20 using a plurality of signal processing algorithms, for example a) interference noise and/or feedback suppression, b) dynamic compression, and c) frequency-dependent amplification based on audiogram data, to compensate for the hearing loss of the user. The respective operating mode of the signal processing algorithms, and thus of the signal processor 12, is determined by a variety of signal processing parameters. The signal processor 12 outputs an output audio signal O, which contains information about the processed and thus modified sound, at the receiver 8. The two signal processing paths 18 and 20 are preferably constructed identically, i.e., have the same signal processing algorithms, which are parameterized differently, however—for processing the ego voice of the user and for processing ambient noise.

The receiver 8 converts the output sound signal O into modified airborne sound. This modified airborne sound is transmitted into the auditory canal of the user via a sound canal 22, which connects the receiver 8 to a tip 24 of the housing 5, and via a flexible sound tube (not explicitly shown), which connects the tip 24 to an earpiece inserted into the auditory canal of the user.

Figure 2:
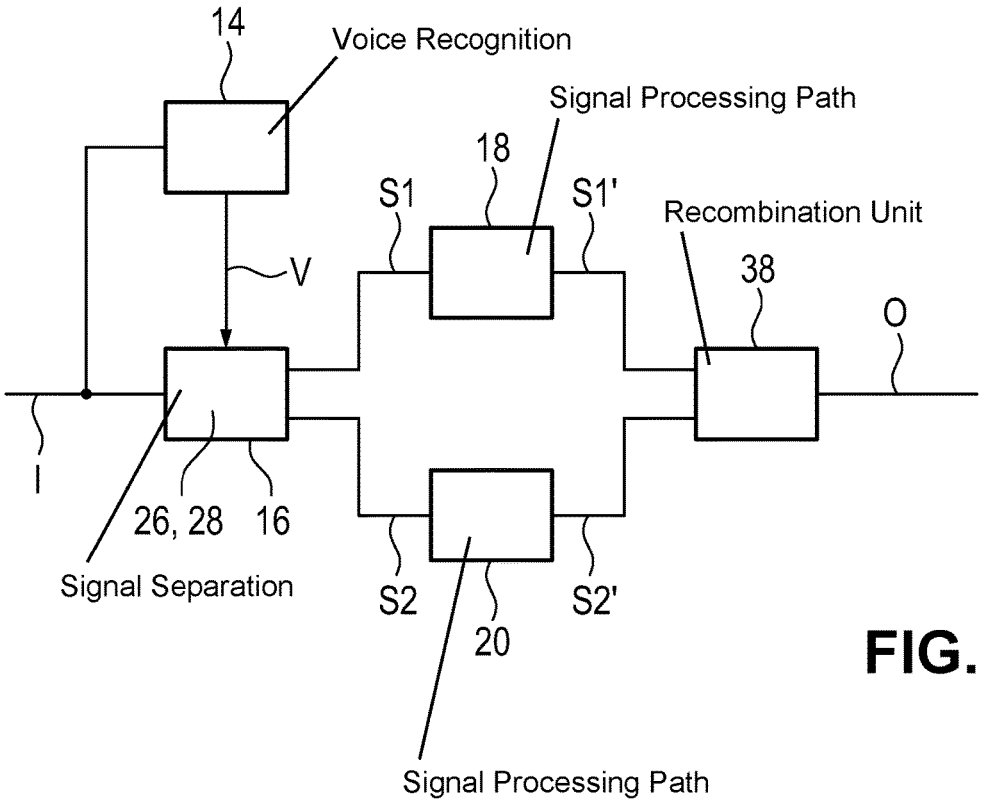
FIG. 2 is a block diagram showing signal processing in the hearing instrument.

The functional interconnection of the above-described components of the signal processor 12 is illustrated in FIG. 2.

The input audio signal I (and thus the received sound signal) is supplied to the ego voice recognition unit 14 and the signal separation unit 16.

The ego voice recognition unit 14 recognizes, for example using one or more of the methods described in U.S. patent publication No. 2013/0148829 A1 or international patent disclosure WO 2016/078786 A1, whether the input audio signal I includes the ego voice of the user. A status signal V dependent on the result of this check (which thus indicates whether or not the input audio signal I contains the ego voice of the user) is supplied by the ego voice recognition unit 14 to the signal separation unit 16.

The signal separation unit 16 handles the supplied input audio signal I in different ways in dependence on the value of the status signal V. In ego voice intervals, i.e., time intervals in which the ego voice recognition unit 14 has recognized the ego voice of the user in the input audio signal I, the signal separation unit 16 derives a first signal component (or ego voice component) S1 from the input audio signal I and a second signal component (or ambient noise component) S2 from the input audio signal I, and supplies these chronologically overlapping signal components S1 and S2 to the parallel signal processing paths 18 and 20, respectively. In intervals in which the input audio signal I does not contain the ego voice of the user, in contrast, the signal separation unit 16 supplies the entire input audio signal I to the signal path 20.

Figure 3:
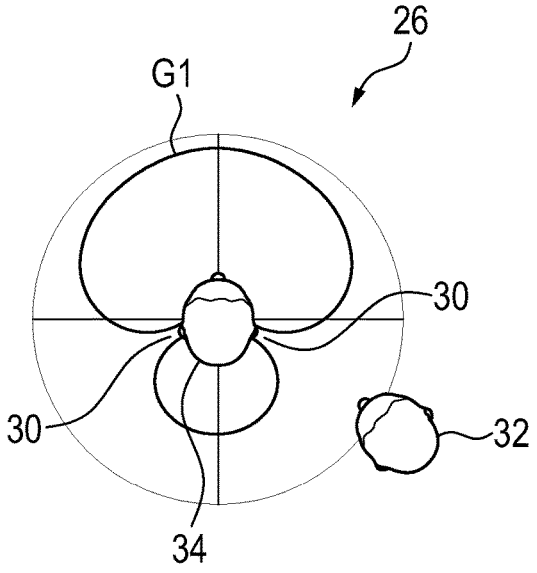
FIGS. 3 and 4 are two schematic diagrams showing a damping characteristic of two direction-dependent damping algorithms (beamformer), which are used in the hearing aid from FIG. 1 to derive the ego voice component or the ambient noise component, respectively, from the received sound signal.
Figure 4:
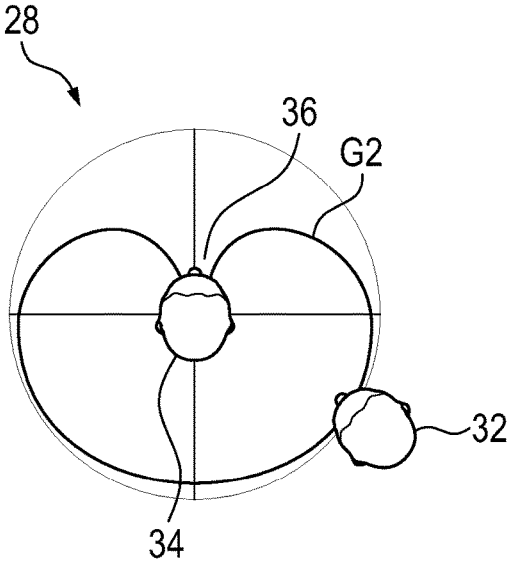

As illustrated in FIGS. 3 and 4, the signal separation unit 16 derives the first signal component S1 and the second signal component S2 by applying different beamformers 26 or 28 (i.e., different algorithms for direction-dependent damping) from the input audio signal I.

In FIG. 3, a damping characteristic G1 of the beamformer 26 used for deriving the first signal component (ego voice component) S1 is shown by way of example. In the illustrated example, the beamformer 26 is an adaptive algorithm (i.e., changeable at any time in operation of the hearing system 2) having two notches 30 (i.e., directions of maximum damping) changeable symmetrically to one another. The damping characteristic G1 is set here in such a way that one of the notches 30 is oriented on a dominant noise source 32 in one spatial volume—at the rear with respect to the head 34 of the user. The dominant noise source 32 is, for example, a speaker standing behind the user. By means of the setting of the damping characteristic G1 shown in FIG. 3, the noise source 32 contributing significantly to the ambient noise is completely or at least nearly completely eliminated in the first signal component S1. In contrast, the components of the input audio signal I—coming from the front with respect to the head 34—in particular the ego voice of the user, are emphasized.

In FIG. 4, in contrast, a damping characteristic G2 of the beamformer 28 used to derive the second signal component (ambient noise component) S2 is shown by way of example. This damping characteristic G2 is in particular static (i.e., chronologically unchanging after the individual fitting of the hearing aid 4 to the user) and corresponds, for example, to an anti-cardioid. A notch 36 of the damping characteristic G2 is oriented on the front side with respect to the head 34 of the user, so that the ego voice of the user is at least substantially suppressed from the second signal component S2.

Moreover, the damping characteristic G2 of the beamformer 28 varies in a frequency-dependent manner, so that the ego voice of the user is optimally damped. In the case shown in FIG. 4, the damping characteristic G2 corresponding to an anti-cardioid results in that the signal of the microphone 6 pointing forward and the signal of the microphone 6 pointing to the rear, which is delayed by a time offset, are superimposed on one another (i.e., added in a weighted or unweighted manner). The time offset is specified as a frequency-dependent function, so that the damping of the ego voice is optimized in the second signal component. An optimized frequency dependence of the time offset is determined by an audiologist during a training session in the course of the hearing aid fitting.

In an alternative embodiment, the beamformer 28 is adaptive, wherein the damping characteristic G2 is adapted in running operation of the hearing system 2 by the signal processor 12 (for example by minimizing the output energy of the beamformer 28 in ego voice intervals).

The first signal component S1 and the second signal component S2 are processed differently in the signal processing paths 18 and 20. The same signal processing algorithms are preferably applied here in different parameterization to the first signal component S1 and the second signal component S2. A parameter set of the signal processing parameters which is optimized for the processing of the ego voice of the user (in particular in individual adaptation to the specific user) is used for processing the first signal component S1. Inter alia, the first signal component S1 including the ego voice of the user is amplified to a lesser extent than the second signal component S2 (or even not amplified at all). Moreover, a lower dynamic compression (i.e., a linear amplification characteristic curve) is applied to the signal component S1 than to the signal component S2.

The signal processing paths 18 and 20 emit processed and thus modified signal components S1' and S2', respectively, to a recombination unit 38, which combines (in particular adds in a weighted or unweighted manner) the modified signal components S1' and S2'. The output audio signal O resulting therefrom is output by the recombination unit 38 (directly or indirectly via further processing steps) at the receiver 8.

The invention is particularly clear from the above-described exemplary embodiments, but is not restricted to these exemplary embodiments. Rather, further embodiments of the invention can be derived by a person skilled in the art from the claims and the preceding description.

The following is a summary list of reference numerals and the corresponding structure used in the above description of the invention:

2 hearing system
4 hearing aid
5 housing
6 microphone
8 receiver
10 battery
12 signal processor
14 (ego voice recognition) unit
16 (signal separation) unit
18 signal processing path
20 signal processing path
22 sound canal
24 tip
26 beamformer
28 beamformer
30 notch
32 noise source
34 head
36 notch
38 recombination unit
G1 damping characteristic
G2 damping characteristic
I (input) audio signal
O (output) audio signal
S1, S1' (first) signal component
S2, S2' (second) signal component
U supply voltage
V status signal

The invention claimed is:

1. A method for operating a hearing system for assisting a sense of hearing of a user, the user having at least one hearing instrument worn in or on an ear of the user, which comprises the steps of:

receiving a sound signal by means of an input transducer of the at least one hearing instrument and a further input transducer of the at least one hearing instrument or a further hearing instrument of the hearing system from surroundings of the at least one hearing instrument, the sound signal at least sometimes includes an ego voice, namely an own voice, of the user as well as ambient noise;

modifying a received sound signal in a signal processing step to assist the sense of hearing of the user, the modifying step includes the following substeps of:

deriving a first signal component and a second signal component from the received sound signal using direction-dependent attenuation, wherein the first and second signal components chronologically overlap, wherein in the first signal component, the ego voice of the user is emphasized over the ambient noise, and wherein in the second signal component, the ambient noise is emphasized over the ego voice of the user, wherein, for deriving the first signal component, a spatial signal component corresponding to the ambient noise is selectively attenuated by means of the direction-dependent attenuation, wherein for deriving the second signal component, a spatial signal component corresponding to an own-voice component is selectively attenuated by means of the direction-dependent attenuation;

processing the first signal component and the second signal component in different ways in the signal processing step;

performing a signal analysis step where own-voice intervals of the received sound signal are detected in which the received sound signal contains the own voice of the user, wherein:

a separation of the received sound signal into the first signal component and the second signal component is carried out only at detected own-voice intervals; or wherein a derivation of the second signal component varies depending on a presence or absence of the own voice of the user by:

using an algorithm optimized for attenuation of the own voice in the own-voice intervals to derive the second signal component; and applying a different algorithm, which is directed to attenuation of a sound source located frontally to the user but remote from the user to intervals of the received sound signal which do not contain the own voice of the user, for derivation of the second signal component;

combining the first signal component and the second signal component after the signal processing step to generate a modified sound signal; and outputting the modified sound signal by means of an output transducer of the hearing instrument.

2. The method according to claim 1, wherein to derive the first signal component, a direction of maximum damping is oriented on a dominant noise source in a rear spatial volume with respect to a head of the user.

3. The method according to claim 1, wherein to derive the second signal component, a direction of maximum damping is oriented exactly or approximately on a front side with respect to a head of the user.

4. The method according to claim 1, wherein the direction-dependent damping used to derive the second signal component has a spatial damping characteristic which is dependent on a frequency of the received sound signal in such a way that the damping of the ego voice is optimized.

5. The method according to claim 1, wherein to derive the first signal component, at least one frequency component of the received sound signal, in which components of the ego voice of the user are not present or are only weakly pronounced, is selectively damped.

6. The method according to claim 1, wherein to derive the second signal component, at least one frequency component of the received sound signal, in which components of the ambient noise are not present or are only weakly pronounced, is selectively damped.

7. The method according to claim 1, wherein the first signal component is amplified in the signal processing step to a lesser extent and/or processed using different dynamic compression than the second signal component.

8. A hearing system for assisting a sense of hearing of a user having at least one hearing instrument worn in or on an ear of the user, the at least one hearing instrument comprising:

an input transducer for receiving a sound signal from surroundings of the at least one hearing instrument;

a further input transducer for receiving the sound signal;

a signal processing unit for modifying the received sound signal to assist the sense of hearing of the user;

an output transducer for outputting a modified sound signal;

wherein the hearing system is configured to automatically carry out a method for operating the hearing system for assisting the sense of hearing of the user, which method comprises the steps of:

receiving the sound signal by means of said input transducer and said further input transducer of the hearing instrument from surroundings of the hearing instrument, the sound signal at least sometimes includes an ego voice, namely an own voice, of the user as well as ambient noise;

modifying the received sound signal in a signal processing step to assist the sense of hearing of the user, the modifying step including the substeps of:

deriving a first signal component and a second signal component from the received sound signal using direction-dependent attenuation, wherein the first and second signal components chronologically overlap, wherein in the first signal component, the ego voice of the user is emphasized over the ambient noise, and wherein in the second signal component, the ambient noise is emphasized over the ego voice of the user, wherein, for deriving the first signal component, a spatial signal component corresponding to the ambient noise is selectively attenuated by means of the direction-dependent attenuation, wherein for deriving the second signal component, a spatial signal component corresponding to an own-voice component is selectively attenuated by means of the direction-dependent attenuation;

processing the first signal component and the second signal component in different ways in the signal processing step;

performing a signal analysis step where own-voice intervals of the recorded sound signal are detected in which the received sound signal contains the own voice of the user, wherein:

a separation of the received sound signal into the first signal component and the second signal component is carried out only at detected own-voice intervals; or wherein a derivation of the second signal component varies depending on a presence or absence of the own voice of the user by:

using an algorithm optimized for attenuation of the own voice in the own-voice intervals to derive the second signal component; and applying a different algorithm, which is directed to attenuation of a sound source located frontally to the user but remote from the user to intervals of the received sound signal which do not contain the own voice of the user, for derivation of the second signal component;

combining the first signal component and the second signal component after the signal processing step to generate the modified sound signal; and outputting the modified sound signal by means of said output transducer of the at least one hearing instrument.

* * * * *